US010230184B1

(12) United States Patent
Myer et al.

(10) Patent No.: US 10,230,184 B1
(45) Date of Patent: Mar. 12, 2019

(54) COMPLIANT PIN WITH AN ENGAGEMENT SECTION

(71) Applicant: TE CONNECTIVITY CORPORATION, Berwyn, PA (US)

(72) Inventors: John Mark Myer, Millersville, PA (US); Hurley Chester Moll, Hershey, PA (US); Ronald Louis Marion, Yadkinville, NC (US); Daniel Williams Fry, Jr., Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/844,791

(22) Filed: Dec. 18, 2017

(51) Int. Cl.

| | |
|---|---|
| ***H01R 12/00*** | (2006.01) |
| ***H01R 12/58*** | (2011.01) |
| ***H01R 12/70*** | (2011.01) |
| ***H01R 43/20*** | (2006.01) |

(52) U.S. Cl.
CPC ..... *H01R 12/585* (2013.01); *H01R 12/7064* (2013.01); *H01R 43/205* (2013.01)

(58) Field of Classification Search
CPC ..... H01R 12/585; H01R 12/7064; H01R 43/205; H01R 12/724; H01R 13/41; H01R 43/16
USPC ..... 439/82, 83
See application file for complete search history.

(56) References Cited

U.S. PATENT DOCUMENTS

| | | | |
|---|---|---|---|
| 4,655,537 | A | 4/1987 | Andrews, Jr. |
| 5,564,954 | A | 10/1996 | Wurster |
| 6,066,128 | A | 5/2000 | Bahmanyar et al. |
| 7,008,272 | B2 | 3/2006 | Blossfeld |
| 7,780,483 | B1 | 8/2010 | Ravlich |
| 8,313,344 | B2 | 11/2012 | Johnescu et al. |
| 9,106,009 | B2 | 8/2015 | Zhao et al. |
| 9,431,733 | B1 | 8/2016 | Heistand et al. |

FOREIGN PATENT DOCUMENTS

| | | | |
|---|---|---|---|
| DE | 102006011657 | A1 | 9/2007 |
| EP | 0387317 | A1 | 9/1990 |

*Primary Examiner* — Khiem Nguyen

(57) ABSTRACT

An electrical contact for insertion into a hole of a substrate. The electrical contact includes a compliant portion having an opening extending between contact arms. At least one contact arm of the contact arms has a resilient engagement section which extends into the opening of the compliant portion and resilient contacting sections which extend from the engagement section in a direction away from the opening. Upon insertion of the compliant portion into the hole of the substrate, the resilient engagement section of the at least one contact arm engages an opposed contact arm of the contact arms, causing each of the resilient contacting sections to move independently of the resilient engagement section and other resilient contacting sections. Each of the resilient engagement section and the resilient contacting sections are deformed and generate independent retention forces which are combined to generate the total retention force of the compliant portion.

18 Claims, 6 Drawing Sheets

COMPLIANT PIN WITH AN ENGAGEMENT SECTION

FIELD OF THE INVENTION

The present invention is directed to an electrical contact with a compliant section for making a solderless electrical connection with an electrical contact hole. In particular, the invention is directed to a compliant section which has an engagement section which allows the compliant section to generate significant retention forces to maintain the compliant section in the electrical contact hole.

BACKGROUND OF THE INVENTION

Solderless press-fit electrical contacts are commonly used for mounting an electrical connector assembly to a circuit board. One example of such an electrical contact includes a compliant contact tail that is shaped to form a pair of beams that join each other at their respective ends with a contact void between the beams. Some of these electrical contacts may be characterized as eye-of-needle electrical contacts. The beams are configured to engage an interior wall of a corresponding plated through-hole in the circuit board during a mounting operation. The configuration of the beams and the contact void allow the beams to be deflected radially inward by the interior wall as the contact tail is inserted into the plated through-hole. Outer surfaces of the beams form a frictional engagement (e.g., interference fit) with the plated through-hole. As such, an electrical connection between the electrical contact and the plated through-hole may be established without the use of solder and with a reduced likelihood of damage occurring to the plated through-hole and/or printed circuit board, which may occur when using rigid electrical contacts.

However, as the size of the contacts and the plated through-holes is reduced, the holding or retention force (resistance to pull-out) is reduced, often below the minimum designated retention force. The lower retention force is largely due to the fact that thinner sheet metal must be used. The need for a considerable retention force for small contacts that fit in very small holes has been increasing as contacts have become smaller to accommodate the need for higher densities of contacts.

Accordingly, there is a need for an electrical contact with a compliant section which provides for sufficient retention force regardless of the size of the contact or the opening into which it is inserted.

SUMMARY OF THE INVENTION

An embodiment is directed to an electrical contact for insertion into a hole of a substrate. The electrical contact includes a compliant portion having an opening extending between contact arms. At least one contact arm of the contact arms has a resilient engagement section which extends into the opening of the compliant portion and resilient contacting sections which extend from the engagement section in a direction away from the opening. Upon insertion of the compliant portion into the hole of the substrate, the resilient engagement section of the at least one contact arm engages an opposed contact arm of the contact arms, causing each of the resilient contacting sections to move independently of the resilient engagement section and other resilient contacting sections. Each of the resilient engagement sections and the resilient contacting sections is deformed and generate independent retention forces which are combined to generate the total retention force of the compliant portion.

An embodiment is directed to an electrical contact for insertion into a hole of a substrate. The electrical contact includes a connector engaging portion and a free end portion. A compliant portion extends between the connector engaging portion and the free end portion. The compliant portion has a first resilient contact arm and a second resilient contact arm. The first resilient contact arm is spaced from the second resilient contact arm by an opening. The first contact arm has an engagement section. A first resilient contact section extends from the connector engaging portion to the engagement section. A second resilient contact section extends from the engagement section to the free end portion. Upon insertion of the compliant portion into the hole of the substrate, the engagement section of the first contact arm engages the second contact arm to prevent further movement of the engagement section, causing the first resilient contact section and the second resilient contact section to move independently of each other. The total retention force of the compliant portion is generated by the total of the forces generated by the first resilient contact section, the second resilient contact section and the engagement section.

An embodiment is directed to a method for generating retention force from an electrical contact inserted into an opening of a substrate, the method comprising: inserting a compliant portion of the electrical contact into the opening of the substrate; forcing resilient portions of the compliant portion toward each other; engaging a first resilient engagement section of a first resilient portion of the resilient portions of the compliant portion with a section of a second resilient portion of the resilient portions of the compliant portion; and moving first resilient contacting sections positioned proximate to and in engagement with the first resilient engagement section to move independently of the first resilient engagement section. Each of the first resilient engagement section and the first resilient contacting sections are deformed and generate independent retention forces which are combined to generate the total retention force of the compliant portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
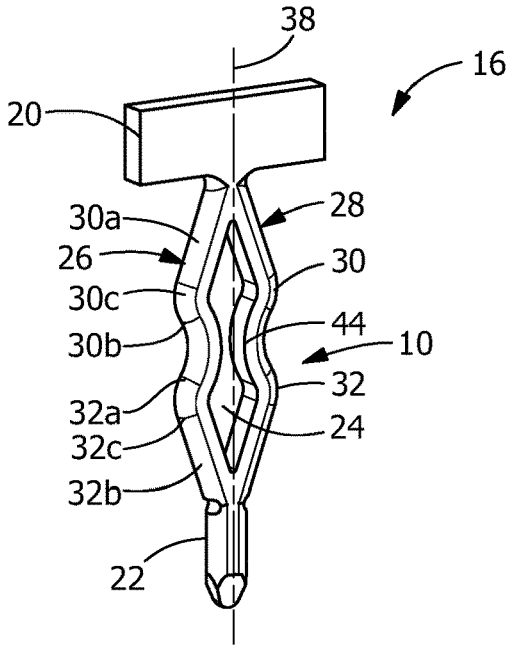
FIG. 1 is a perspective view of a first illustrative embodiment of a compliant pin according the present invention, the compliant pin is shown prior to insertion into a plated through-hole of a printed circuit board.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
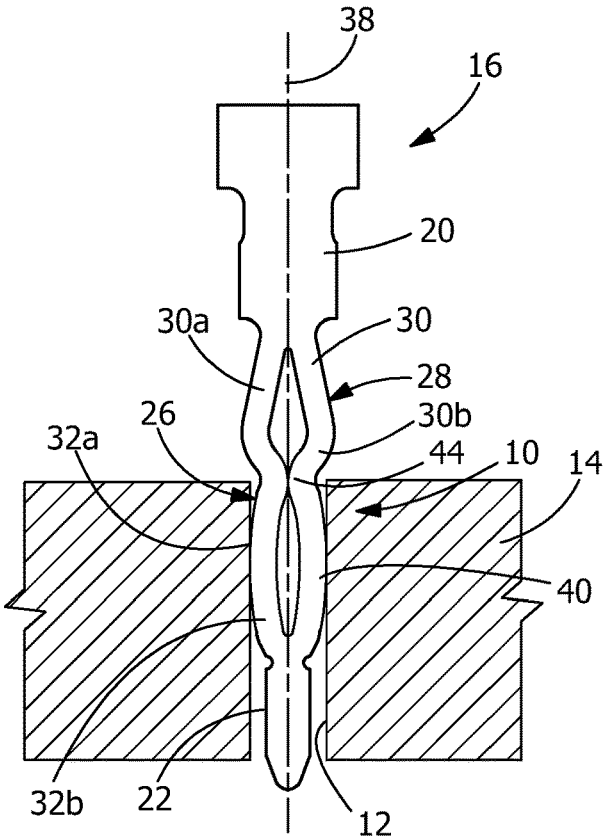
FIG. 2 is a cross-sectional view of the compliant pin of FIG. 1 partially inserted into the printed circuit board.
Figure 3:
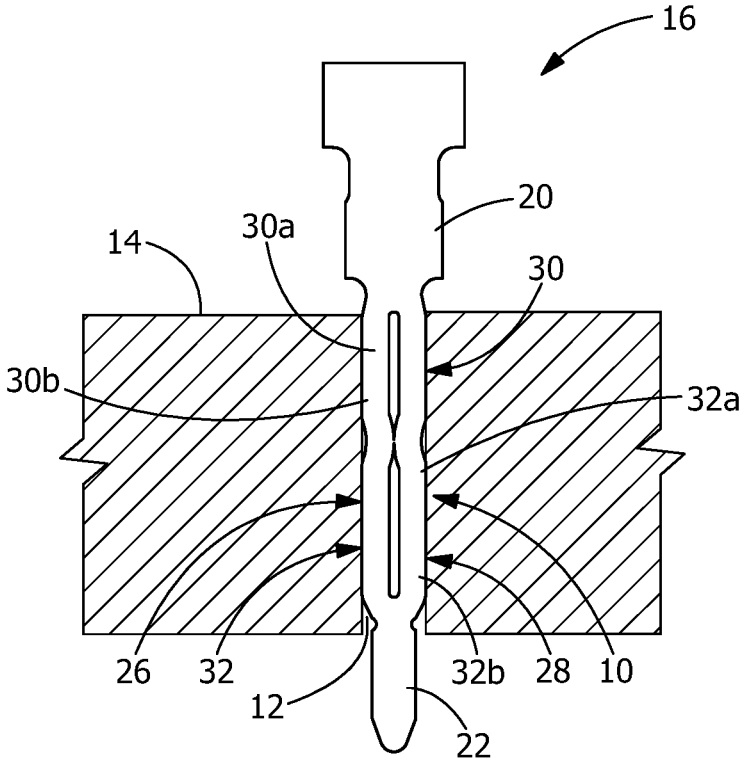
FIG. 3 is a cross-sectional view of the compliant pin of FIG. 1 fully inserted into the printed circuit board.

Compliant section or portion 10, shown in FIGS. 1 through 3, may be included into any one of several different electrical contacts or pins 16 which are mounted in holes, such as a plated through-holes 12 or the like, in a substrate, such as a printed circuit board 14 or the like. The compliant section 10 is that part of an electrical contact or pin 16 which is driven into plated through-hole 12 and retained therein by the resilient characteristics of the section 10. The force required to insert the compliant portion 10 into hole 12 and the force required to withdraw the compliant portion 10 from the hole are important characteristics of the compliant portion 10. The configuration and operation of the compliant portion 10 contribute to both the force required to insert the compliant portion 10 into hole 12 and the force required to withdraw the compliant portion 10.

The compliant section or portion 10 includes contact arms 26, 28 positioned between a connector engaging portion 20 and free end portion 22. As these portions 20, 22 can be of any shape and are not directly relevant to the present invention, they are not shown in detail. As best shown in FIG. 1, the free end portion 22 has a diameter that is less than the diameter of the hole 12 of the substrate 14 and less than the width of the compliant portion 10 prior to the compliant portion 10 being inserted into the hole 12.

The pin 16 and compliant portion 10 are formed by stamping a flattened portion of stock (not shown), resulting in the compliant portion 10 having an opening 24 positioned between a first contact arm 26 and a second contact arm 28 and extending between the connector engaging portion 20 and the free end portion 22. The compliant portion 10 extends between the connector engaging portion 20 and the free end portion 22.

In the illustrative embodiment shown in FIGS. 1 through 3, the second contact arm 28 is a mirror image of the first contact arm 26. Each contact arm 26, 28 has a first resilient contact section 30 and a second resilient contact section 32. Each contact arm 26, 28 also has an engagement section 44.

The first resilient contact sections 30 include first segments 30*a* and second segments 30*b*. The first segments 30*a* are attached to the connector engaging portion 20 and extend downwardly and obliquely outward from a longitudinal axis 38 of the electrical contact 16. The second segments 30*b* are attached to the first segments 30*a* by first arcuate transition portions 30*c* and extend downwardly and obliquely toward the longitudinal axis 38 of the electrical contact 16. The resilient engagement sections 44 are positioned at the ends of the second segments 30*b*. The first segments 30*a* and second segments 30*b* may have straight or arcuate configurations.

The second resilient contact sections 32 include third segments 32*a* and fourth segments 32*b*. The third segments 32*a* are attached to the resilient engagement sections 44 and extend downwardly and obliquely outward from a longitudinal axis 38 of the electrical contact 16. The fourth segments 32*b* are attached to the third segments 32*a* by second arcuate transition portions 32*c* and extend downwardly and obliquely toward the longitudinal axis 38 of the electrical contact 16. The fourth segments 32*b* are attached at an opposite end to the free end portion 22. The third segments 32*a* and fourth segments 32*b* may have straight or arcuate configurations.

As shown in FIG. 1, the resilient engagement section 44 extends into or narrows the opening 24. The resilient contact sections 30, 32 extend outward from the opening 24.

In this illustrative embodiment, the first segments 30*a* are equal or have the same length as the fourth segments 32*b*. In addition, the second segments 30*b* are equal or have the same length as the third segments 32*a*. However, other configurations may be used without departing from the scope of the invention.

The outwardly facing surfaces of the contact arms 26, 28 are curved from side to side, i.e., transverse to the axis 38 of contact 16. The curvature may be symmetrical or non-symmetrical.

The overall configuration of the contact arms 26, 28 are such as to define an angular bowed compliant section with a disruption therein occasioned by the engagement section 44.

The insertion of compliant section 10 into plated through-hole 12 is illustrated in FIGS. 2 and 3. With reference to FIG. 2, as the contact 16 is pushed downward, the contact arms 26, 28 enter the hole 12 and the fourth segments 32*b* of the second resilient contact sections 32 engage the wall of the hole 12. The engagement of the fourth segments 32*b* with the wall of the hole 12 causes the fourth segments 32*b*, the third segments 32*a* and the second resilient contact sections 32 of the contact arms 26, 28 to resiliently deform inward, toward the axis 38.

Due to the size of the hole 12 and the width of the compliant section 10, as insertion continues, the second resilient contact sections 32 of the contact arms 26, 28 continue to deform inwardly until the engagement section 44 of the first resilient arm 26 and the engagement section 44 of the second resilient arm 28 are moved into engagement, thereby preventing further inward movement of the engagement sections 44. It should be noted that the size of the opening 12 and the width of the compliant section 10 cause the total deflection of the first and second arms 26, 28 to vary.

With the engagement sections 44 engaged, the engagement sections 44 effectively become a fixed point, causing further movement or deformation of the second resilient contact sections 32 to be independent of the further movement or deformation of the first resilient contact sections 30.

As insertion continues, the second resilient contact sections 32 continue to be moved or resiliently deformed and provide increased insertion forces and retention forces as the second resilient contact sections 32 are deformed. The forces are accentuated in that the attachment of second resilient contact sections 32 to the free end portion 22 is fixed and the engagement of the engagement sections 44 causes the engagement sections 44 to be fixed.

As insertion continues, the second segments 30*b* of the first resilient contact sections 30 engage the hole 12 causing the second segments 30*b*, the first segment 30*a* and the first resilient contact sections 30 to be moved or resiliently deformed and provide increased insertion forces and retention forces as the first resilient contact sections 30 are deformed. The forces associated with the first resilient contact sections 30 are accentuated in that the first resilient contact sections 30 has the fixed engagement sections 44 at one end and the fixed connector engaging portion 20 at the other end.

Depending upon the size of the opening or hole into which the compliant portion 10 is inserted, portions of the first resilient contact section 30 and/or the second resilient contact section 32 are provided in electrical engagement with the plated through-hole 12.

The use of the engagement sections 44 allows the compliant portion 10 to operate as a traditional eye of the needle compliant portion when first inserted into the opening 12, thereby allowing for low insertion forces when the compliant portion 10 is initially inserted. However, once the engagement sections 44 are in engagement, the resilient contact sections 30, 32 act as independent spring members, thereby providing significantly more retention force than can be generated by known compliant pins, as represented by curve 1002 in FIG. 10.

As the first resilient contact sections 30 and the second resilient contact sections 32 are moved inward about fixed points or are compressed to form a less curved path, the overall length of the compliant portion 10 may increase.

Figure 4:
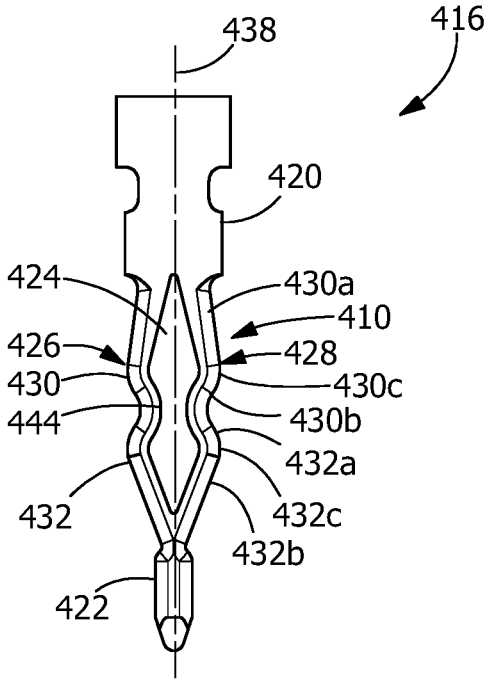
FIG. 4 is a two-dimensional orthogonal view of a second illustrative embodiment of a compliant pin according the present invention.

A second illustrative compliant section or portion 410 is shown in FIG. 4. The compliant section or portion 410 includes contact arms 426, 428 positioned between a connector engaging portion 420 and free end portion 422. As these portions 420, 422 can be of any shape and are not directly relevant to the present invention, they are not shown in detail. The free end portion 422 has a diameter that is less than the diameter of the hole 12 of the substrate 14 and less than the width of the compliant portion 410 prior to the compliant portion being inserted into the hole 12.

The pin 416 and compliant portion 410 are formed by stamping a flattened portion of stock (not shown), resulting in the compliant portion 410 having an opening 424 positioned between a first contact arm 426 and a second contact arm 428. The compliant portion 410 extends between the connector engaging portion 420 and the free end portion 422.

The second contact arm 428 is a mirror image of the first contact arm 426. Each contact arm 426, 428 has a first resilient contact section 430 and a second resilient contact section 432. Each contact arm 426, 428 also has an engagement section 444.

The first resilient contact sections 430 include first segments 430*a* and second segments 430*b*. The first segments 430*a* are attached to the connector engaging portion 420 and extend downwardly and obliquely outward from a longitudinal axis 438 of the electrical contact 416. The second segments 430*b* are attached to the first segments 430*a* by first arcuate transition portions 430*c* and extend downwardly and obliquely toward the longitudinal axis 438 of the electrical contact 416. The resilient engagement sections 444 are positioned at the ends of the second segments 430*b*. The first segments 430*a* and second segments 430*b* may have straight or arcuate configurations.

The second resilient contact sections 432 include third segments 432*a* and fourth segments 432*b*. The third segments 432*a* are attached to the resilient engagement sections 444 and extend downwardly and obliquely outward from a longitudinal axis 438 of the electrical contact 416. The fourth segments 432*b* are attached to the third segments 432*a* by second arcuate transition portions 432*c* and extend downwardly and obliquely toward the longitudinal axis 438 of the electrical contact 416. The fourth segments 432*b* are attached at an opposite end to the free end portion 422. The third segments 432*a* and fourth segments 432*b* may have straight or arcuate configurations.

As shown in FIG. 4, the resilient engagement section 444 extends into or narrows the opening 424. The resilient contact sections 430, 432 extend outward from the opening 424.

In this illustrative embodiment, the first segments 430*a* are greater in length than the fourth segments 432*b*. In addition, the second segments 430*b* are equal or have the same length as the third segments 432*a*. However, other configurations may be used without departing from the scope of the invention.

The outwardly facing surfaces of the contact arms 426, 428 are curved from side to side, i.e., transverse to the axis 438 of contact 416. The curvature may be symmetrical or non-symmetrical.

The overall configuration of the contact arms 426, 428 are such as to define an angular bowed compliant section with a disruption therein occasioned by the engagement section 444.

During insertion into the hole, the contact 416 is pushed downward, causing the contact arms 426, 428 enter the hole. As this occurs, the fourth segments 432*b* of the second resilient contact sections 432 engage the wall of the hole. The engagement of the fourth segments 432*b* with the wall of the hole causes the fourth segments 432*b*, the third segments 432*a* and the second resilient contact sections 432 of the contact arms 426, 428 to resiliently deform inward, toward the axis 438.

Due to the size of the hole and the width of the compliant section 410, as insertion continues, the second resilient contact sections 432 of the contact arms 426, 428 continue to deform inwardly until the engagement section 444 of the first resilient arm 426 and the engagement section 444 of the second resilient arm 428 are moved into engagement, thereby preventing further inward movement of the engagement sections 444. It should be noted that the size of the opening and the width of the compliant section 410 cause the total deflection of the first and second arms 426, 428 to vary.

With the engagement sections 444 engaged, the engagement sections 444 effectively become a fixed point, causing further movement or deformation of the second resilient contact sections 432 to be independent of the further movement or deformation of the first resilient contact sections 430.

As insertion continues, the second resilient contact sections 432 continue to be moved or resiliently deformed and provide increased insertion forces and retention forces as the second resilient contact sections 432 are deformed. The forces are accentuated in that the attachment of second resilient contact sections 432 to the free end portion 422 is fixed and the engagement of the engagement sections 444 causes the engagement sections 444 to be fixed.

As insertion continues, the second segments 430*b* of the first resilient contact sections 430 engage the hole causing the second segments 430*b*, the first segment 430*a* and the first resilient contact sections 430 to be moved or resiliently deformed and provide increased insertion forces and retention forces as the first resilient contact sections 430 are deformed. The forces associated with the first resilient contact sections 430 are accentuated in that the first resilient contact sections 430 has the fixed engagement sections 444 at one end and the fixed connector engaging portion 420 at the other end, as represented by curve 1004 in FIG. 10.

Depending upon the size of the opening or hole into which the compliant portion 410 is inserted, portions of the first resilient contact section 430 and/or the second resilient contact section 432 are provided in electrical engagement with the plated through-hole.

The use of the engagement sections 444 allows the compliant portion 410 to operate as a traditional eye of the needle compliant portion when first inserted into the opening, thereby allowing for low insertion forces when the compliant portion 410 is initially inserted. However, once the engagement sections 444 are in engagement, the resilient contact sections 430, 432 act as independent spring members, thereby providing significantly more retention force than can be generated by known compliant pins.

As the first resilient contact sections 430 and the second resilient contact sections 432 are moved inward about fixed points or are compressed to form a less curved path, the overall length of the compliant portion 410 may increase.

Figure 5:
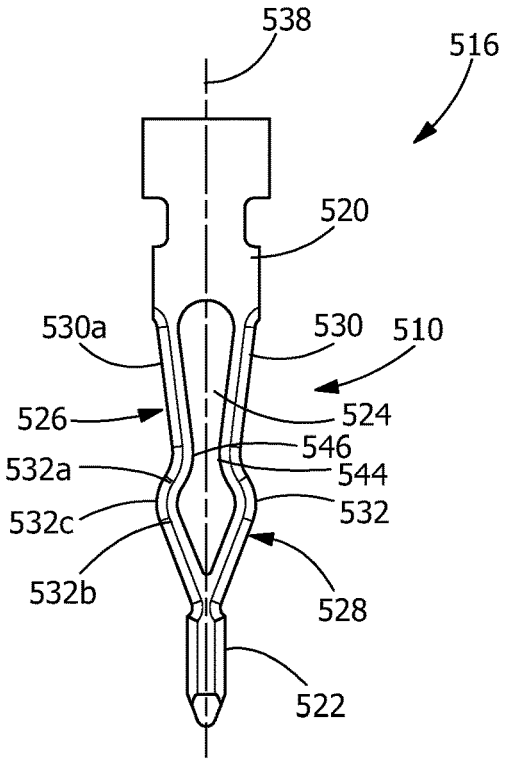
FIG. 5 is a two-dimensional orthogonal view of a third illustrative embodiment of a compliant pin according the present invention.

A third illustrative compliant section or portion 510 is shown in FIG. 5. The compliant section or portion 510 includes contact arms 526, 528 positioned between a connector engaging portion 520 and free end portion 522. As these portions 520, 522 can be of any shape and are not directly relevant to the present invention, they are not shown in detail. The free end portion 522 has a diameter that is less than a diameter of the hole 12 of the substrate 14 and less than the width of the compliant portion 510 prior to the compliant portion being inserted into the hole 12.

The pin 516 and compliant portion 510 are formed by stamping a flattened portion of stock (not shown), resulting in the compliant portion 510 having an opening 524 positioned between a first contact arm 526 and a second contact arm 528. The compliant portion 510 extends between the connector engaging portion 520 and the free end portion 522.

The second contact arm 528 is a mirror image of the first contact arm 526. Each contact arm 526, 528 has a first resilient contact section 530 and a second resilient contact section 532. Each contact arm 526, 528 also has an engagement section 544.

The first resilient contact sections 530 include first segments 530*a* which are attached to the connector engaging portion 520 and extend downwardly and straight or obliquely inward toward a longitudinal axis 538 of the electrical contact 516. The resilient engagement sections 544 are positioned at the ends of the first segments 530*a*. The first segments 530*a* may have straight or arcuate configurations.

The second resilient contact sections 532 include second segments 532*a* and third segments 532*b*. The second segments 532*a* are attached to the resilient engagement sections 544 and extend downwardly and obliquely outward from a longitudinal axis 538 of the electrical contact 516. The third segments 532*b* are attached to the second segments 532*a* by first arcuate transition portions 532*c* and extend downwardly and obliquely toward the longitudinal axis 538 of the electrical contact 516. The third segments 532*b* are attached at an opposite end to the free end portion 522. The second segments 532*a* and third segments 532*b* may have straight or arcuate configurations.

As shown in FIG. 5, the resilient engagement section 544 extends into or narrows the opening 524. The resilient contact sections 530, 532 extend outward from the opening 524.

In this illustrative embodiment, the first segments 530*a* are greater in length than the third segments 532*b*. However, other configurations may be used without departing from the scope of the invention.

The outwardly facing surfaces of the contact arms 526, 528 are curved from side to side, i.e., transverse to the axis 538 of contact 516. The curvature may be symmetrical or non-symmetrical.

The overall configuration of the contact arms 526, 528 are such as to define an angular bowed compliant section with a disruption therein occasioned by the engagement section 544.

During insertion into the hole, the contact 516 is pushed downward, causing the contact arms 526, 528 enter the hole. As this occurs, the third segments 532*b* of the second resilient contact sections 532 engage the wall of the hole. The engagement of the third segments 532*b* with the wall of the hole causes the third segments 532*b*, the secondd segments 532*a* and the second resilient contact sections 532 of the contact arms 526, 528 to resiliently deform inward, toward the axis 538.

Due to the size of the hole and the width of the compliant section 510, as insertion continues, the second resilient contact sections 532 of the contact arms 526, 528 continue to deform inwardly until the engagement section 544 of the first resilient arm 526 and the engagement section 544 of the second resilient arm 528 are moved into engagement, thereby preventing further inward movement of the engagement sections 544. It should be noted that the size of the opening and the width of the compliant section 510 cause the total deflection of the first and second arms 526, 528 to vary.

With the engagement sections 544 engaged, the engagement sections 544 effectively become a fixed point, causing further movement or deformation of the second resilient contact sections 532 to be independent of the further movement or deformation of the first resilient contact sections 530.

As insertion continues, the second resilient contact sections 532 continue to be moved or resiliently deformed and provide increased insertion forces and retention forces as the second resilient contact sections 532 are deformed. The forces are accentuated in that the attachment of second resilient contact sections 532 to the free end portion 522 is fixed and the engagement of the engagement sections 544 causes the engagement sections 544 to be fixed.

As insertion continues, the first segments 530*a* of the first resilient contact sections 530 engage the hole causing the first segments 530*a* and the first resilient contact sections 530 to be moved or resiliently deformed and provide increased insertion forces and retention forces as the first resilient contact sections 530 are deformed. The forces associated with the first resilient contact sections 530 are accentuated in that the first resilient contact sections 530 has the fixed engagement sections 544 at one end and the fixed connector engaging portion 520 at the other end, as represented by curve 1006 in FIG. 10.

Depending upon the size of the opening or hole into which the compliant portion 510 is inserted, portions of the first resilient contact section 530 and/or the second resilient contact section 532 are provided in electrical engagement with the plated through-hole.

The use of the engagement sections 544 allows the compliant portion 510 to operate as a traditional eye of the needle compliant portion when first inserted into the opening, thereby allowing for low insertion forces when the compliant portion 510 is initially inserted. However, once the engagement sections 544 are in engagement, the resilient contact sections 530, 532 act as independent spring members, thereby providing significantly more retention force than can be generated by known compliant pins.

As the first resilient contact sections 530 and the second resilient contact sections 532 are moved inward about fixed points or are compressed to form a less curved path, the overall length of the compliant portion 510 may increase.

Figure 6:
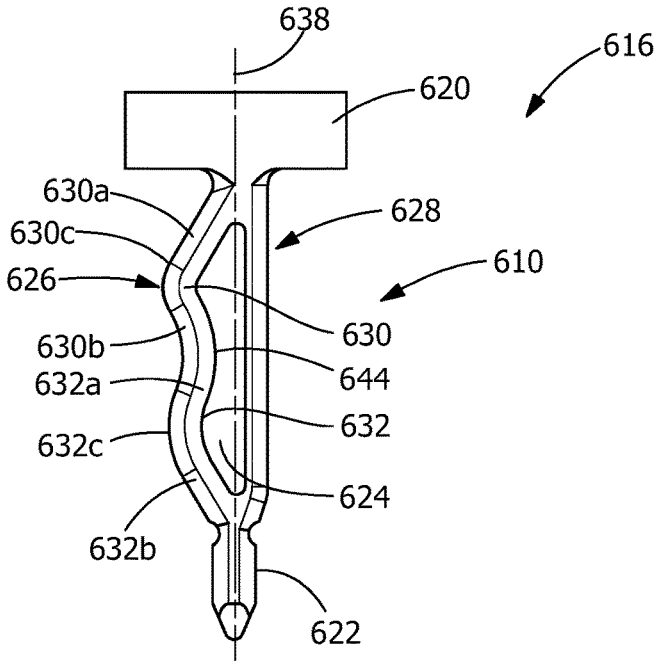
FIG. 6 is a two-dimensional orthogonal view of a fourth illustrative embodiment of a compliant pin according the present invention.

A fourth illustrative compliant section or portion 610 is shown in FIG. 6. The compliant section or portion 610 includes contact arms 626, 628 positioned between a connector engaging portion 620 and free end portion 622. As these portions 620, 622 can be of any shape and are not directly relevant to the present invention, they are not shown in detail. The free end portion 622 has a diameter that is less than the diameter of the hole 12 of the substrate 14 and less than the width of the compliant portion 610 prior to the compliant portion being inserted into the hole 12.

The pin 616 and compliant portion 610 are formed by stamping a flattened portion of stock (not shown), resulting in the compliant portion 610 having an opening 624 positioned between a first contact arm 626 and a second contact arm 628. The compliant portion 610 extends between the connector engaging portion 620 and the free end portion 622.

The second contact arm 628 is essentially a straight beam which extends from the connector engaging portion 620 to the free end portion 622. The first contact arm 626 has a first resilient contact section 630 and a second resilient contact section 632. The first contact arm 626 also has an engagement section 644.

The first resilient contact section 630 include a first segment 630*a* and a second segment 630*b*. The first segment 630*a* is attached to the connector engaging portion 620 and extends downwardly obliquely outward from a longitudinal axis 638 of the electrical contact 616. The second segment 630*b* is attached to the first segment 630*a* by first arcuate transition portion 630*c* and extends downwardly and obliquely inwardly toward the longitudinal axis 638 of the electrical contact 616. The resilient engagement section 644 is positioned at the end of the second segment 630*b*. The first segment 630*a* and second segment 630*b* may have straight or arcuate configurations.

The second resilient contact section 632 includes a third segment 632*a* and a fourth segments 632*b*. The third segment 632*a* is attached to the resilient engagement section 644 and extends downwardly and obliquely outward from a longitudinal axis 638 of the electrical contact 616. The fourth segment 632*b* is attached to the third segment 632*a* by a second arcuate transition portion 632*c* and extends downwardly and obliquely toward the longitudinal axis 638 of the electrical contact 616. The fourth segment 632*b* is attached at an opposite end to the free end portion 622. The third segment 632*a* and fourth segment 632*b* may have straight or arcuate configurations.

As shown in FIG. 6, the resilient engagement section 644 extends into or narrows the opening 624. The resilient contact sections 630, 632 extend outward from the opening 624.

In this illustrative embodiment, the first segment 630*a* is essentially equal in length to the fourth segment 632*b*. In addition, the second segment 630*b* is equal or have the same length as the third segment 632*a*. However, other configurations may be used without departing from the scope of the invention.

The outwardly facing surface of the contact arm 626 is curved from side to side, i.e., transverse to the axis 638 of contact 616. The curvature may be symmetrical or non-symmetrical. The outwardly facing surface of the contact arm 628 is straight.

The overall configuration of the contact arm 626 is such as to define an angular bowed compliant section with a disruption therein occasioned by the engagement section 644.

During insertion into the hole, the contact 616 is pushed downward, causing the contact arms 626, 628 enter the hole. As this occurs, the fourth segment 632*b* of the second resilient contact section 632 engages the wall of the hole. The engagement of the fourth segment 632*b* with the wall of the hole causes the fourth segment 632*b*, the third segment 632*a* and the second resilient contact section 632 of the contact arm 626 to resiliently deform inward, toward the axis 638.

Due to the size of the hole and the width of the compliant section 610, as insertion continues, the second resilient contact section 632 of the contact arm 626 continues to deform inwardly until the engagement section 644 of the first resilient arm 626 is moved into engagement with the second contact arm 628, thereby preventing further inward movement of the engagement section 644. It should be noted that the size of the opening and the width of the compliant section 610 cause the total deflection of the first and second arms 626, 628 to vary.

With the engagement section 644 engaged, the engagement section 644 effectively become a fixed point, causing further movement or deformation of the second resilient contact section 632 to be independent of the further movement or deformation of the first resilient contact section 630.

As insertion continues, the second resilient contact section 632 continues to be moved or resiliently deformed and provide increased insertion forces and retention forces as the second resilient contact section 632 is deformed. The forces are accentuated in that the attachment of second resilient contact section 632 to the free end portion 622 is fixed and the engagement of the engagement section 644 causes the engagement section 644 to be fixed.

As insertion continues, the second segment 630*b* of the first resilient contact section 630 engages the hole causing the second segment 630*b*, the first segment 630*a* and the first resilient contact section 630 to be moved or resiliently deformed and provide increased insertion forces and retention forces as the first resilient contact section 630 is deformed. The forces associated with the first resilient contact section 630 are accentuated in that the first resilient contact section 630 has the fixed engagement section 644 at one end and the fixed connector engaging portion 620 at the other end.

Depending upon the size of the opening or hole into which the compliant portion 610 is inserted, portions of the first resilient contact section 630 and/or the second resilient contact section 632 are provided in electrical engagement with the plated through-hole.

The use of the engagement section 644 allows the compliant portion 610 to operate as a traditional eye of the needle compliant portion when first inserted into the opening, thereby allowing for low insertion forces when the compliant portion 610 is initially inserted. However, once the engagement section 644 is in engagement with the second contact arm 628, the resilient contact sections 630, 632 act as independent spring members, thereby providing significantly more retention force than can be generated by known compliant pins.

As the first resilient contact sections 630 and the second resilient contact sections 632 are moved inward about fixed points or are compressed to form a less curved path, the overall length of the compliant portion 610 may increase. This may result in the free end 622 being moved out of alignment with the axis 638 of the electrical contact 616.

Figure 7:
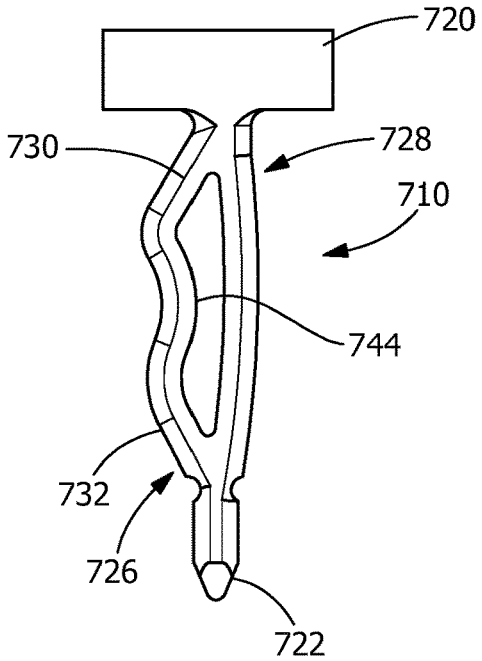
FIG. 7 is a two-dimensional orthogonal view of a fifth illustrative embodiment of a compliant pin according the present invention.

A fifth illustrative compliant section or portion 710 is shown in FIG. 7. In this embodiment, the second contact arm 728 has a slightly curved or arcuate configuration which extends from the connector engaging portion 720 to the free end portion 722. The first contact arm 726 has a contact section 730, a second contact section 732, and an engagement section 744. The operation of the compliant section or portion 710 is similar to that of the compliant section or portion 610.

Figure 8:
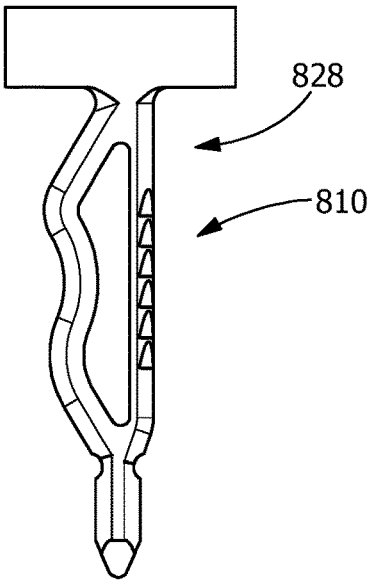
FIG. 8 is a two-dimensional orthogonal view a sixth illustrative embodiment of a compliant pin according the present invention.

A sixth illustrative compliant section or portion 810 is shown in FIG. 8. In this embodiment, the second contact arm 828 is textured to provide additional frictional forces between the second contact arm 828 and the wall of the hole 12. The operation of the compliant section or portion 810 is similar to that of the compliant section or portion 610.

The textured surface may be provided on either or both of the contact arms of any of the embodiments of the compliant section. In addition, the configuration of the type of texturing used can vary.

Figure 9:
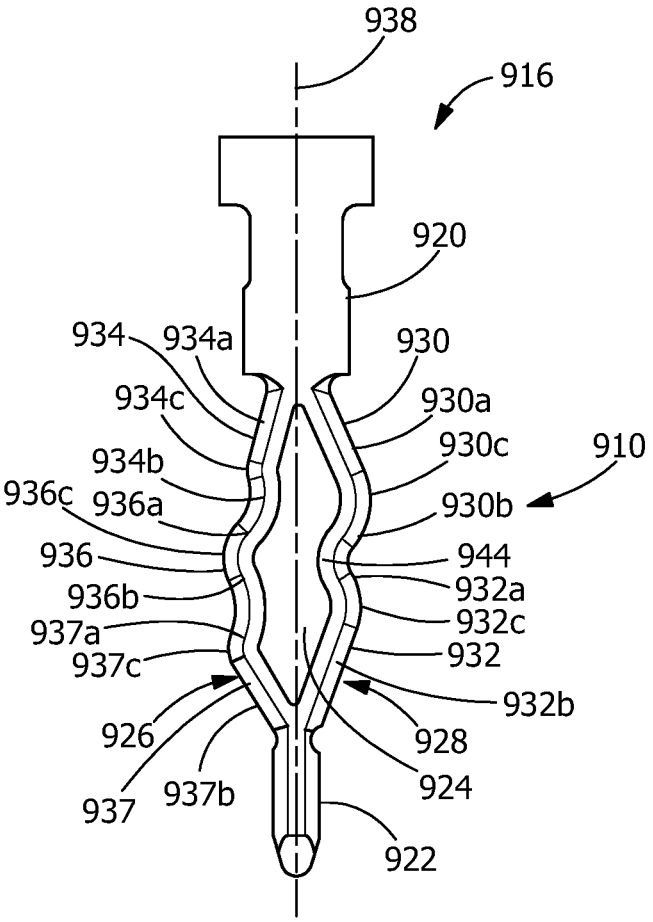
FIG. 9 is a two-dimensional orthogonal view of a seventh illustrative embodiment of a compliant pin according the present invention.

A seventh illustrative compliant section or portion 910 is shown in FIG. 9. The compliant section or portion 910 includes contact arms 926, 928 positioned between a connector engaging portion 920 and free end portion 922. As these portions 920, 922 can be of any shape and are not directly relevant to the present invention, they are not shown in detail. The free end portion 922 has a diameter that is less than the diameter of the hole 12 of the substrate 14 and less than the width of the compliant portion 910 prior to the compliant portion being inserted into the hole 12.

The pin 916 and compliant portion 910 are formed by stamping a flattened portion of stock (not shown), resulting in the compliant portion 910 having an opening 924 positioned between a first contact arm 926 and a second contact arm 928. The compliant portion 910 extends between the connector engaging portion 920 and the free end portion 922.

In this illustrative embodiment the second contact arm 928 has a different configuration than the first contact arm 926. The second contact arm 928 has a first contact section 930, a second contact section 932, and an engagement section 944. The configuration of the first contact section 930, a second contact section 932, and an engagement section 944 are identical to the configuration of the first segment 30, the second segment 32 and the engagement section 44 of FIGS. 1 through 3 which was previously described and will not be repeated. The first contact arm 926 has a first resilient contact section 934, a second resilient contact section 936 and a third resilient contact section 937.

The first resilient contact section 934 of the first contact arm 926 include a first segment 934*a* and a second segment 934*b*. The first segment 934*a* is attached to the connector engaging portion 920 and extends downwardly and obliquely outward from a longitudinal axis 938 of the electrical contact 916. The second segment 934*b* is attached to the first segment 934*a* by a first arcuate transition portion 934*c* and extends downwardly and obliquely toward the longitudinal axis 938 of the electrical contact 916. The first segment 934*a* and second segment 934*b* may have straight or arcuate configurations.

The second resilient contact section 936 includes a third segment 936*a* and a fourth segment 936*b*. The third segment 936*a* is attached to the second segment 934*b* and extends downwardly and obliquely outward from a longitudinal axis 938 of the electrical contact 916. The fourth segment 936*b* is attached to the third segment 936*a* by a second arcuate transition portions 936*c* and extends downwardly and obliquely toward the longitudinal axis 938 of the electrical contact 916. The third segment 936*a* and fourth segment 936*b* may have straight or arcuate configurations.

The third resilient contact section 937 includes a fifth segments 937*a* and a sixth segments 937*b*. The fifth segment 937*a* is attached to the sixth segments 937*b* and extends downwardly and obliquely outward from a longitudinal axis 938 of the electrical contact 916. The sixth segment 937*b* is attached to the fifth segment 937*a* by third arcuate transition portion 937*c* and extends downwardly and obliquely toward the longitudinal axis 938 of the electrical contact 916. The sixth segment 937*b* is attached at an opposite end to the free end portion 922. The fifth segment 937*a* and sixth segment 937*b* may have straight or arcuate configurations.

As the contact 916 is pushed downward, the contact arms 926, 928 enter the hole and the fourth segment 932*b* of the second resilient contact section 932 of the second contact arm 928 and the sixth segment 937*b* of the third contact section 937 of the first contact arm 926 engage the wall of the hole. The engagement of the fourth segment 932*b* with the wall of the hole causes the fourth segment 932*b*, the third segment 932*a* and the second resilient contact section 932 of the second contact arm 928 to resiliently deform inward, toward the axis 938. The engagement of the sixth segment 937*b* with the wall of the hole causes the sixth segment 937*b*, the fifth segment 937*a* and the third resilient contact section 937 of the first contact arm 926 to resiliently deform inward, toward the axis 938.

Due to the size of the hole 12 and the width of the compliant section 10, as insertion continues, the contact sections 932, 937 continue to deform inwardly until the engagement section 944 of the second resilient contact arm 928 and the second contact section 936 of the first contact arm 926 are moved into engagement, thereby preventing further inward movement of the engagement section 944 and the second contact section 936. It should be noted that the size of the opening and the width of the compliant section 910 cause the total deflection of the first and second arms 926, 928 to vary.

With the engagement section 944 engaged with the second contact section 936, the engagement section 944 and the second contact section 936 effectively become fixed points, causing further movement or deformation of the second resilient contact section 932 to be independent of the further movement or deformation of the first resilient contact section 930 and causing further movement or deformation of the third resilient contact section 937 to be independent of the further movement or deformation of the first resilient contact section 934.

As insertion continues, the second resilient contact section 932 and the third resilient contact section 937 continue to be moved or resiliently deformed and provide increased insertion forces. The forces are accentuated in that the attachment of second resilient contact sections 932 and the third resilient contact section 937 to the free end portion 922 is fixed.

As insertion continues, the second segment 930*b* of the first resilient contact section 930 and the second segment 934*b* of the first resilient contact section engage the hole causing the second segments 930*b*, 937*b* and the first resilient contact sections 930, 937 to be moved or resiliently deformed and provide increased insertion forces and retention forces as the first resilient contact sections 930, 934 are deformed. The forces associated with the first resilient contact sections 930, 934 are accentuated in that the first resilient contact sections 930, 934 are attached to the fixed connector engaging portion 920, as represented by curve 1008 in FIG. 10.

Depending upon the size of the opening or hole into which the compliant portion 910 is inserted, portions of the first resilient contact section 930, the second resilient contact section 932, the first resilient contact section 934, the second resilient contact section 936, and/or the third resilient contact section 937 are provided in electrical engagement with the plated through-hole.

The use of the engagement sections 944 allows the compliant portion 910 to operate as a traditional eye of the needle compliant portion when first inserted into the opening, thereby allowing for low insertion forces when the compliant portion 910 is initially inserted. However, once the engagement section 944 is in engagement with the second resilient contact section 936, the resilient contact sections 930, 932, 934, 936, 937 act as independent spring members, thereby providing significantly more retention force than can be generated by known compliant pins.

As the first resilient contact sections 930, 932, 934, 936, 937 are moved inward about fixed points or are compressed to form a less curved path, the overall length of the compliant portion 10 may increase.

Figure 10:
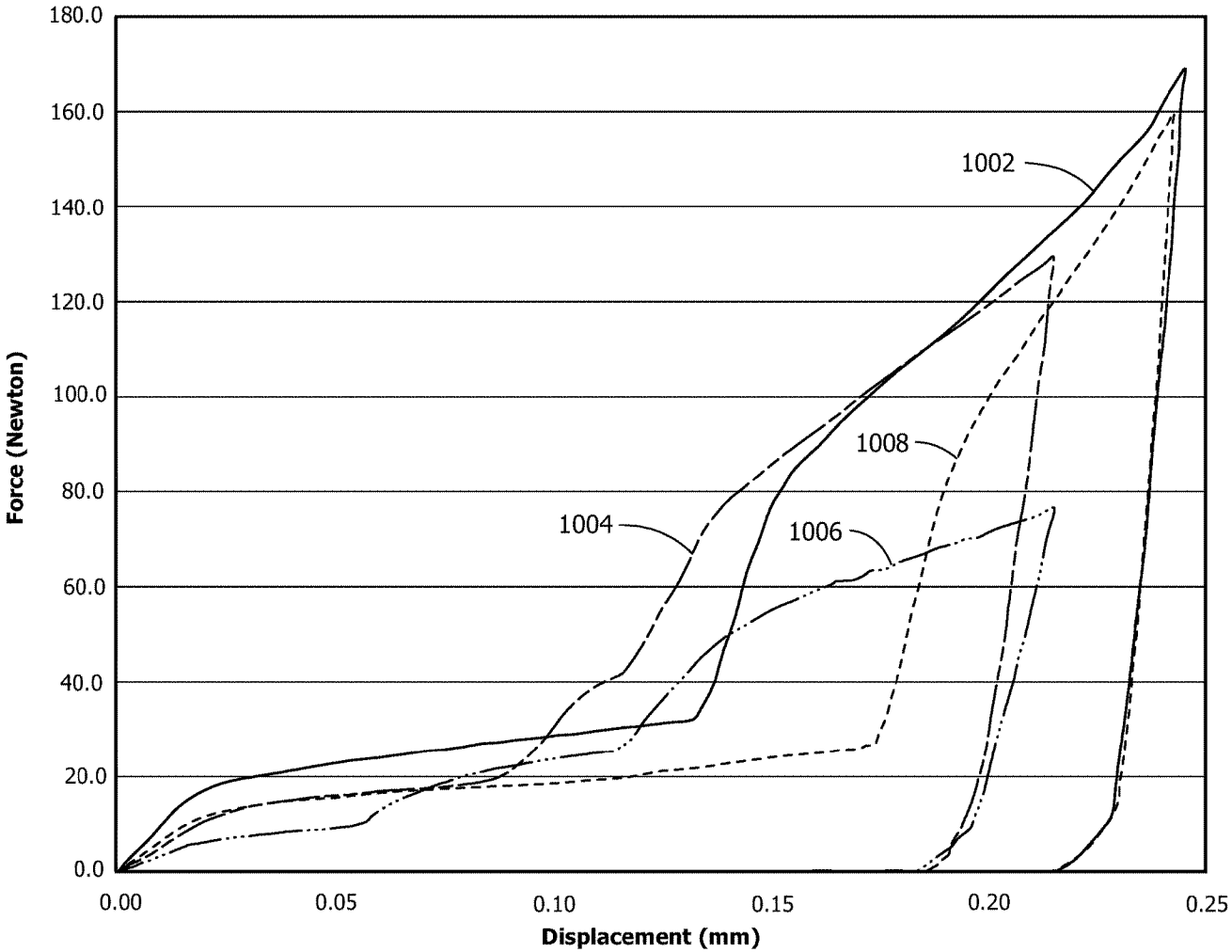
FIG. 10 is a graph showing the force v. deflection plots for the embodiments.

Referring to FIG. 10, representative force versus displacement plots of each of the embodiment is shown. The plots illustrate that low redial force is required during the initial insertion of the compliant portions into the holes. The force increases once the resilient engagement sections engage to create a fixed or bottoming point, causing further movement or deformation of the resilient contact sections to be independent. In addition, these plots illustrate that the retention force for each embodiment remains strong, as sufficient recoverable energy is obtained due to the configuration of the compliant portions, thereby allowing the compliant portion of the present invention to be used in harsh environments in which vibration and the like are present, for example, in automotive applications. Curve 1002 is representative of the force versus displacement plot for the illustrative embodiment shown in FIG. 1. Curve 1004 is representative of the force versus displacement plot for the illustrative embodiment shown in FIG. 4. Curve 1006 is representative of the force versus displacement plot for the illustrative embodiment shown in FIG. 5. Curve 1008 is representative of the force versus displacement plot for the illustrative embodiment shown in FIG. 9. While specific embodiments are shown, other embodiments may have different force versus displacement plots without departing from the scope of the invention.

The method of generating retention force from an electrical contact inserted into an opening of a substrate according to the present invention included: inserting a compliant portion of the electrical contact into the opening of the substrate; forcing resilient portions of the compliant portion toward each other; engaging a first resilient engagement section of a first resilient portion of the resilient portions of the compliant portion with a section of a second resilient portion of the resilient portions of the compliant portion; and moving first resilient contacting sections positioned proximate to and in engagement with the first resilient engagement section to move independently of the first resilient engagement section. Wherein each of the first resilient engagement sections and the first resilient contacting sections are deformed and generate independent retention forces which are combined to generate the total retention force of the compliant portion.

The method may also include moving second resilient contacting sections positioned proximate to and in engagement with the second resilient engagement section to move independently of the second resilient engagement section. Wherein each of the second resilient engagement section and the second resilient contacting sections are deformed and generate independent retention forces, the independent retention forces of the second resilient engagement section and the second resilient contacting sections and the independent retention forces of the first resilient engagement section and the first resilient contacting sections which are combined to generate the total retention force of the compliant portion.

The compliant portion, as described herein, can be used with pins of all sizes and all materials, including with 0.50 mm×0.40 mm size pins in which the material stock thickness is 0.4 mm or less. In addition, as the resilient contact arms have a longer lengths than known compliant portions, the compliant portions of the present invention minimize the possibility of fracturing occurring when the compliant portions are inserted into the hole.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical contact for insertion into a hole of a substrate, the electrical contact comprising:

a compliant portion having an opening extending between contact arms;

at least one contact arm of the contact arms having a first resilient contacting section and a second resilient contacting section, and engagement section positioned between the first resilient contacting section and the second resilient contacting section, an outwardly facing surface of the engagement section positioned closer to a longitudinal axis of the electrical contact than an outwardly facing surface of the first resilient contacting section and an outwardly facing surface of the second resilient contacting section;

wherein upon insertion of the compliant portion into the hole of the substrate, the engagement section of the at least one contact arm engages an opposed contact arm of the contact arms to become a fixed point, causing the first resilient contacting section to move independently of the engagement section and the second resilient contacting section;

wherein the first resilient contacting section and the second resilient contacting section are deformed and generate independent retention forces which are combined to generate the total retention force of the compliant portion.

2. The electrical contact as recited in claim 1, wherein the electrical contact has a connector engaging portion and a free end portion, the compliant portion extending between the connector engaging portion and the free end portion, the free end portion having diameters that are less than a diameter of the hole of the substrate.

3. The electrical contact as recited in claim 2, wherein a first segment of the first resilient contacting section of a first contact arm of the at least one contact arm of the contact arms is attached to the connector engaging portion and extends obliquely outward from the longitudinal axis of the electrical contact.

4. The electrical contact as recited in claim 3, wherein a second segment of the first resilient contacting section of the first contact arm of the at least one contact arm of the contact arms is attached to the first segment by a first arcuate transition portion and extends obliquely toward the longitudinal axis of the electrical contact and is attached to the engagement section.

5. The electrical contact as recited in claim 4, wherein a third segment of the second resilient contacting section of the first contact arm of the at least one contact arm of the contact arms is attached to the engagement section and extends obliquely from the longitudinal axis of the electrical contact.

6. The electrical contact as recited in claim 5, wherein a fourth segment of the second resilient contacting section of the resilient contacting sections of the first contact arm of the at least one contact arm of the contact arms is attached at one end to the third segment by a third arcuate transition portion and extends obliquely outward from a longitudinal axis of the electrical contact, the fourth segment is attached at an opposite end to the free end portion.

7. The electrical contact as recited in claim 6, wherein the second segment and third segment have arcuate configurations.

8. The electrical contact as recited in claim 6, wherein the opening extends from the connector engaging portion to the free end portion.

9. The electrical contact as recited in claim 6, wherein a second contact arm of the at least one contact arm of the contact arms is straight and extends from the connector engaging portion to the free end portion.

10. The electrical contact as recited in claim 6, wherein a second contact arm of the at least one contact arm of the contact arms has an arcuate configuration and extends from the connector engaging portion to the free end portion.

11. The electrical contact as recited in claim 6, wherein a second contact arm extends from the connector engaging portion to the free end portion and is a mirror image of the first contact arm.

12. The electrical contact as recited in claim 6, wherein the first segment and the fourth segment have a same length.

13. The electrical contact as recited in claim 6, wherein the first segment and the fourth segment have different lengths.

14. The electrical contact as recited in claim 6, wherein the first segment is a cantilever spring anchored at the connector engaging portion and the fourth segment is a cantilever spring anchored at the free end portion.

15. The electrical contact as recited in claim 1, wherein outside surfaces of the at least one contact arm which face away from the opening have a rounded configuration.

16. The electrical contact as recited in claim 1, wherein outside surfaces of the at least one contact arm which face away from the opening are textured.

17. An electrical contact for insertion into a hole of a substrate, the electrical contact comprising:

a connector engaging portion and a free end portion, a compliant portion extending between the connector engaging portion and the free end portion;

the compliant portion having a first resilient contact arm and a second resilient contact arm, the first resilient contact arm is spaced from the second resilient contact arm by an opening;

the first contact arm has an engagement section, a first resilient contact section extends from the connector engaging portion to the engagement section, a second resilient contact section extends from the engagement section to the free end portion, a substrate facing surface of the engagement section positioned closer to a longitudinal axis of the electrical contact than a substrate facing surface of the first resilient contact section and a substrate facing surface of the second resilient contact section;

wherein upon insertion of the compliant portion into the hole of the substrate, the first resilient contact sections and the second resilient contact section engage the hole of the substrate and the engagement section of the first contact arm engages the second contact arm to prevent further movement of the engagement section, causing the first resilient contact section and the second resilient contact section to move independently of each other;

wherein the total retention force of the compliant portion is generated by the total of the forces generated by the first resilient contact section, the second resilient contact section and the engagement section.

18. The electrical contact as recited in claim 17, comprising:

the second contact arm has a second engagement section, a third resilient contact section extends from the connector engaging portion to the second engagement section, a fourth resilient contact section extends from the engagement section to the free end portion;

wherein upon insertion of the compliant portion into the hole of the substrate, the engagement section of the first contact arm engages the second engagement section of the second contact arm, to prevent further movement of the engagement section and the second engagement section, causing the first resilient contact section, the second resilient contact section, the third resilient contact section and the fourth resilient contact section to move independently of each other.

* * * * *